United States Patent [19]

Slater et al.

[11] Patent Number: 4,478,342

[45] Date of Patent: Oct. 23, 1984

[54] STERILIZABLE CONTAINER WITH INNER CLOSURE AND COLLAPSE-RESISTANT COVER

[75] Inventors: Glenn L. Slater, Ingleside; Gerhard H. Weiler, South Barrington; Robert Turoff, Wheeling; Lawrence Kitterman, Antioch, all of Ill.

[73] Assignee: Baxter Travenol Laboratories, Inc., Deerfield, Ill. ; by said Slater, Turoff and Kitterman

[21] Appl. No.: 513,593

[22] Filed: Jul. 14, 1983

[51] Int. Cl.[3] ..... B65D 1/02

[52] U.S. Cl. ..... 215/32; 215/251; 215/355; 215/1 C

[58] Field of Search ..... 215/32, 33, 251, 1 C, 215/355; 264/89, 90; 222/541; 220/266

[56] References Cited

U.S. PATENT DOCUMENTS

| | | | |
|---|---|---|---|
| 3,851,029 | 11/1974 | Cornett et al. | 264/89 |
| 3,919,374 | 11/1975 | Komendowski | 264/90 |
| 3,994,412 | 11/1976 | Difiglio | 220/266 |
| 4,176,755 | 12/1979 | Winchell | 215/32 |
| 4,226,334 | 10/1980 | Weiler et al. | 215/355 |
| 4,319,701 | 3/1982 | Cambio | 222/541 |
| 4,378,891 | 4/1983 | Fowles et al. | 215/32 |
| 4,402,415 | 9/1983 | Hopley | 215/32 |
| 4,405,053 | 9/1983 | Cherot | 215/32 |

FOREIGN PATENT DOCUMENTS 2105250 3/1983 United Kingdom .

OTHER PUBLICATIONS

U.S.S.N. 296,368, filed Aug. 26, 1981, Weiler et al.
U.S.S.N. 402,982, filed Aug. 3, 1982, Weiler.

*Primary Examiner*—George T. Hall
*Attorney, Agent, or Firm*—John P. Kirby, Jr.; Bradford R. L. Price; Gary McFarron

[57] ABSTRACT

A container which includes body, neck and cover portions of one-piece plastic construction and a line of weakness defined between the neck and cover portions to permit selective separation of the cover from the neck, further includes an inner closure carried by and removable with the cover portion to prevent spillage of the container contents upon opening of the container. The inner closure is disposed to seal the neck below the line of weakness to isolate the contents of the container from the area of the line of weakness. When the container is heat sterilized, means is provided associated with the chamber defined by the cover and closure to prevent collapse of the cover during the post heat-sterilization cooling cycle. The associated means includes structure to provide moist air in the defined chamber during heating of the container without endangering the sterility of the container contents or nullifying the advantage of the inner closure.

32 Claims, 8 Drawing Figures

FIG. 4
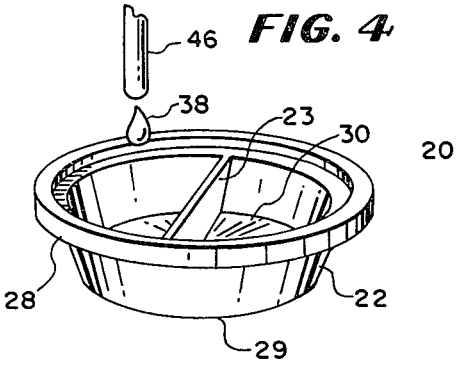
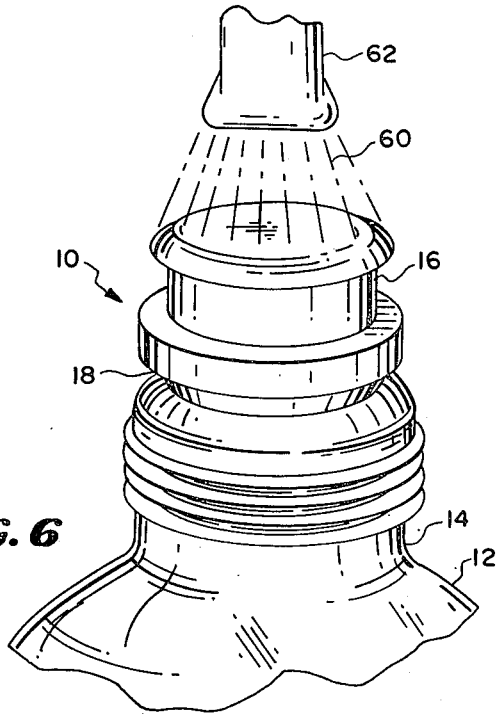
FIG. 6
FIG. 7
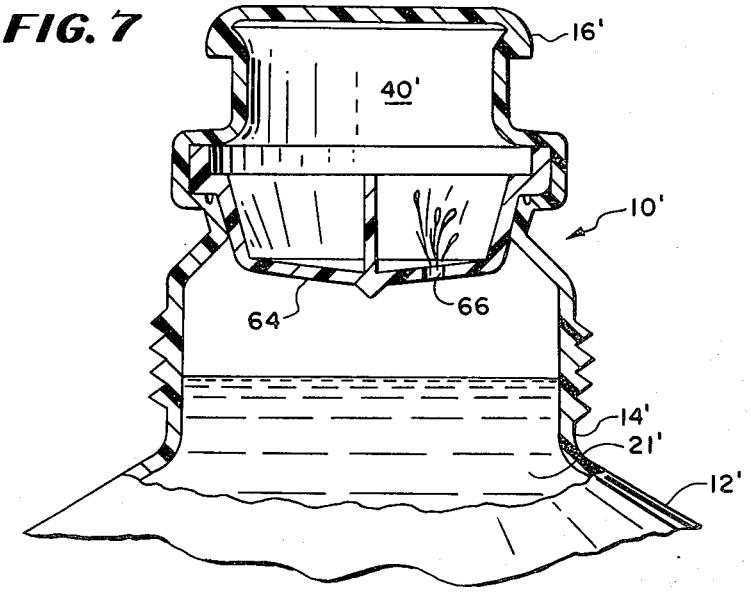

STERILIZABLE CONTAINER WITH INNER CLOSURE AND COLLAPSE-RESISTANT COVER

DESCRIPTION

Technical Field of the Invention

The present invention relates to plastic containers having body, neck and cover portions of one-piece construction, wherein a frangible line of weakness is disposed between the cover and the neck to permit opening of the containers. The invention is particularly directed to a container having a separate inner closure to isolate the container contents below the frangible line of weakness and further to a heat sterilized container for medical fluids.

Background of the Invention

Plastic containers having one-piece, integral construction, including the cover, are known. Typically, an area of reduced wall thickness is made between the cover and the container neck. The cover is removed by rotating a threaded neck ring which exerts an axial force, either in compression or tension, on the cover and fractures the area of reduced wall thickness.

Although containers of this type have found application in the medical industry, e.g., for storing and dispensing sterile liquids, on occasion a minute amount of liquid sometime spills onto the outer surface of the container during opening. This is the result of small amounts of the liquid accumulating in the area of reduced wall thickness. This may occur, for example, during shipping or handling, via splashing or sloshing, or tilting of the container. When this area is fractured during opening, the liquid may escape onto the exterior surface of the container, typically onto the neck threads. Although the medical significance of such small amounts of liquid on the container threads is subject to debate, it is generally recognized as being commercially undesirable.

Summary of the Invention

The container of the present invention provides an inexpensive solution to the above difficulties. The container of the present invention includes body, neck and cover portions of one-piece plastic construction. The line of weaknesss is defined between the neck and cover portions to permit selective separation of the cover portion from the neck portion. A separately formed inner closure member is provided in the one-piece container, which inner closure is carried by the cover and isolates the container contents below the frangible line of weakness. The inner closure serves as a liquid seal of the container contents from the line of weakness so that when the container is opened by breaking the frangible line of weakness, the inner closure is removed with the cover and liquid will not escape onto the exterior surface of the container. Further, the container is relatively easy to manufacture without substantially increasing production costs.

Preferably, the inner closure has a tapered side wall which nests tightly against a tapered annular seat on the neck portion of the container, below the frangible line of weakness. The nesting engagement provides a liquid-tight seal between the inner closure and the neck while permitting easy withdrawal of the inner closure with removal of the cover. Where circumstances permit, e.g., where sterility of the contents is not required, the nesting arrangement also permits resealing of the container in the event all of the contents are not used.

In medical applications, the contents of the container is typically sterilized by the application of heat sufficient to destroy germs and microbes which would otherwise make the container contents medically unacceptable. After heat sterilization, the exterior of the containers are typically splashed with water such as from shower-type spraying nozzles. This drastically reduces the cooling time of the containers, which therefore also drastically reduces the time for the plastic, perhaps as hot as 250° F. upon heating, to set, and enables earlier handling by equipment or people at a subsequent work station. Thus, the decreased cooling cycle time caused by the water spray greatly increases the speed by which the containers may be manufactured, thereby improving efficiency.

Heat sterilization has presented a difficulty with this improved container. During the cooling step, it has been found in some instances that the cover of the container has a tendancy to collapse. Such collapse is highly undesirable for a number of reasons. The collapse of the cover may make subsequent installation and operation of the threaded neck ring on the cover impossible. The collapse of the cover may create additional stress on the preformed line of weakness sufficient to destroy the effectiveness of the container as a sterile barrier to the container contents at the line of weakness. The added stress may be sufficient to actually break the line of weakness. Additionally, the collapsed cover has a misshapen appearance which makes the container commercially unacceptable.

The problem of cover collapse in the container of the present invention is solved by providing means associated with the chamber defined by the cover portion and the inner closure, which means prevents collapse of the cover portion during cooling, after the container has been subjected to heat-sterilization. The means includes structure to provide moist air in the defined chamber while still preventing moisture in the defined chamber from dripping out of the defined chamber onto the exterior surface of the container upon the opening thereof.

In one embodiment, the collapse prevention means includes a defined chamber which is closed to chamber-external moisture. A small volume of liquid is carried in the defined chamber, segregated from the defined volume. The liquid is dispensed into the inner closure before the formation of the cover and the chamber defined by both the cover and the inner closure.

In an alternate embodiment of the invention, the defined chamber is not closed. Instead, a vent is provided. The vent is disposed between the chamber and the defined volume of the container and includes an opening in the inner closure in communication with the defined volume of the container. The opening is small enough to prevent moisture in the defined chamber from dripping therethrough.

A modified inner closure including projecting rings is also suggested for use in either embodiment, in order to further assure that no moisture in the defined chamber leaks out above the line of weakness.

DESCRIPTION OF THE DRAWINGS

FIG. 4 is a perspective view depicting the addition of liquid into the inner closure.

FIG. 6 is a perspective view of the container during the post-heating cooling step.

FIG. 7 is a vertical, sectional view of the neck and closure portion of another embodiment of the invention.

DETAILED DESCRIPTION OF THE PREFERRED EMBODIMENTS

Figure 1:
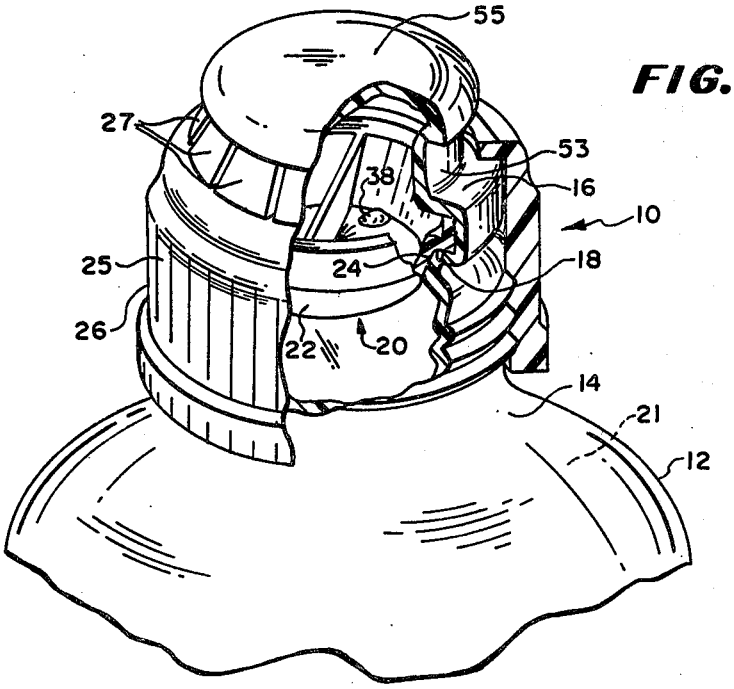
FIG. 1 is a perspective view of a container according to the present invention, with portions of the removal ring, cover, inner closure and neck broken away to illustrate the features thereof, including the defined chamber and the pre-assembly added liquid.
Figure 2:
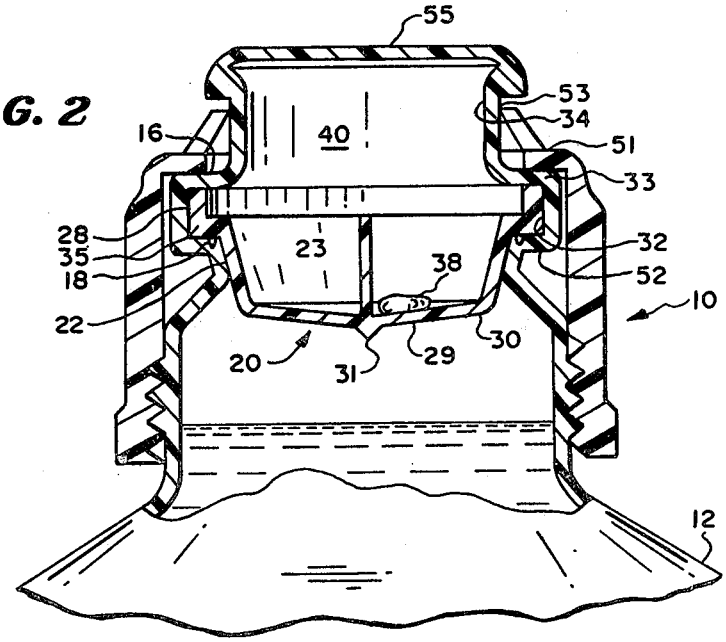
FIG. 2 is a vertical, sectional view of the neck and closure portion of the container of FIG. 1.
Figure 3:
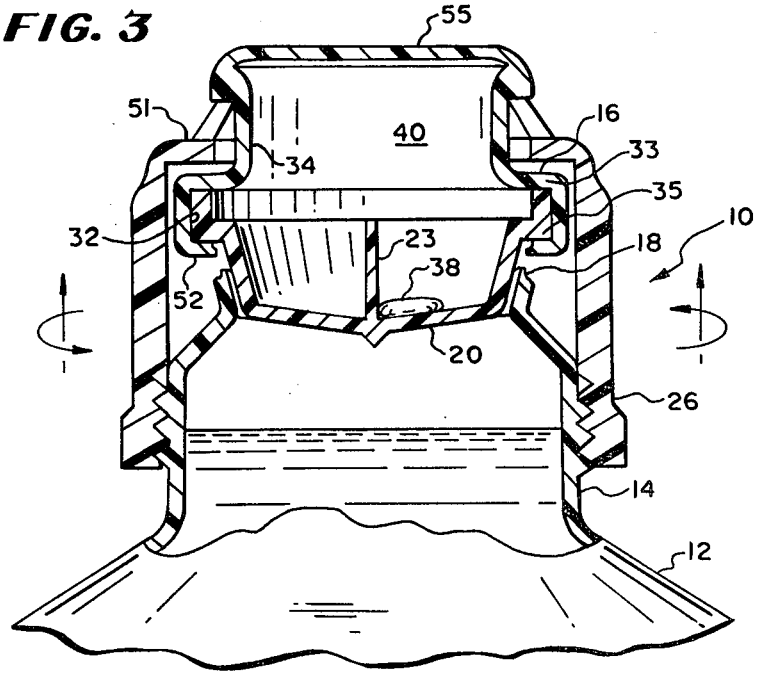
FIG. 3 is a vertical, sectional view of the neck and closure portion of the container, illustrating the removal of the container cover and inner closure by rotation of the outer removal ring, with the pre-assembly liquid still in the defined chamber.

Referring to FIGS. 1 through 3, the present invention is generally embodied in a one-piece, hermetically sealed plastic container 10 of the type having a body portion 12, a neck portion 14 and an outer cover or closure portion 16, which is separated from the neck portion by a line of weakness, such as a line of reduced wall thickness 18. The container contents are isolated to the area below the line of weakness 18, in the defined volume 21, by an inner closure 20 which is carried by the cover portion 16 of the container and is disposed to seal the neck of the container at a position below the line of weakness 18. In the preferred embodiment, the inner closure 20 preferably has a tapered side wall 22 which nestingly engages against a tapered wall portion 24 of the neck, below the line of weakness. The nesting engagement provides a water tight seal against the passage of liquid beyond the inner closure, but permits quick removal of the inner closure with the cover. The outer cover 16 may be removed by a threaded removal or jacking ring 26 which is threadedly received on the neck portion 14 of the container and which, upon rotation, exerts an upward axial force on the cover, causing fracturing at the line of reduced wall thickness 18, as seen in FIG. 3.

More particularly, in the preferred embodiments of the invention the container 10 is made of a thermoplastic material, such as polyethylene or polypropylene, suitable for blowmolding in the desired shape of the container body, e.g., round or rectangular. The container body narrows at its upper end to form the neck portion 14, which is externally threaded to receive the jacking ring 26. The upper end of the neck wall slants or tapers inwardly and then outwardly, forming the inside tapered surface 24 against which the inner closure 20 seats. The angle of taper on the neck wall portion preferably matches the angle of taper of the side wall 22 of the inner closure member for a liquid-tight surface-to-surface seal. The upper cover 16 is joined to the neck portion along an annular shoulder 52, within which the continuous line of reduced wall thickness 18 is provided.

The cover portion 16 of the container extends upwardly from the annular shoulder 52. The wall of the cover forms an annular indented channel 53 and terminates in a top wall 55.

The inner closure 20 resembles a shallow pan, and includes an upper, radially extending, circular, annular rim 35, the inwardly tapered annular side wall 22, a diametrical web 23 and a bottom wall 30 which is of smaller diameter than the upper rim 35. The upper rim 35 includes a cylindrical wall portion 28 of slightly larger diameter than the upper edge of the tapered side wall 22. The bottom wall 30 preferably includes a sloping outer surface 29 terminating in a rather steeply sloped tip 31. The upper rim 35 is received within a groove 32 in the interior surface 34 of the cover portion 16, so that when the cover portion 16 is lifted by the threaded removal ring 26, the inner closure 20 is lifted with it. To provide a liquid-tight seal therebetween, the inner closure 20 is tightly engaged against the tapered surface 24 of the neck portion 14. The wedging or nesting action provided by the cooperative taper of the inner closure side wall 22 and the tapered surface 24 of the neck provides a liquid-tight seal, isolating the container contents below the inner closure 20 and the line of weakness 18, even under various temperature and humidity conditions which the container may experience, while still permitting easy withdrawal of the inner closure from the neck simultaneously with removal of the container cover portion 16.

The inner closure is preferably made also of a rigid plastic material, such as polyethylene or polypropylene, suitable for injection molding or for other plastic forming operations. It is also preferred that the inner closure be made of a material different from that of the container neck portion, to insure that there is no unintentional bonding between the closure and the container neck during heat sterilization, storage or the like.

To achieve withdrawal of the inner closure 20 at the same time the container cover 16 is removed, the rim 35 of the inner closure is secured to the side wall of the cover. In the preferred embodiment, the cylindrical wall portion 28 of the rim 35 is captured tightly within the groove 32 of the container cover 16, i.e., the cylindrical wall portion 28 extends fully between the outwardly extending annular shoulder 52 and the upper horizontal return portion 33, which form the groove 32.

Although other techniques may be available for removing the cover (e.g., bending the cover to break the frangible connection), in the preferred embodiments a removal or jacking ring 26 is provided for a twist-off removal of the closure including the cover 16 and the inner closure 20. The jacking ring 26 is of rigid plastic construction also, and has a generally cylindrical side wall 25, with a plurality of upwardly and inwardly extending fingers 27 along the upper edge of the side wall. The fingers 27 are sufficiently flexible to permit attachment of the jacking ring to the container. When the jacking ring is rotated upwardly in the opposite direction, the ends of the fingers engage the upper edge of the indented channel 53 in the cover and exert an upward axial force thereon. As illustrated in FIG. 3, with a moderate twisting force applied to the ring 26, sufficient upward axial force may be generated to cause fracture along the line of reduced wall thickness 18, resulting in a lifting of the cover 16 as well as the inner closure 20 which is carried by the cover 16. The sloped outer surface 29, including the tip 31, of the inner closure 20 prevents any of the liquid contents in the defined volume 21 from adhering to the bottom wall surface so that upon opening of the container 10 there is no liquid on the surface 29 to drip outside of the container 10.

Where circumstances permit, such as in non-medical applications where sterility of the contents is unimportant, the present construction also permits resealing of the container. After removal, the cover 16 and inner closure 20 remain captured by the fingers 27 of the removal ring 26. Upon reattachment of the removal ring 26 to the container neck, the internal shoulder 51 of the removal ring 26 engages and presses against the return wall portion 33 of the outer cover. When tightened, the removal ring forces the inner closure 20 into close resealing contact with the tapered surface 24 of the container neck, sealing any remaining contents within the container.

As seen in FIGS. 1 through 3, a volume of liquid 38 is intentionally disposed within a chamber 40 defined by the cover portion 16 and the inner closure 20. It is believed that as little as a single drop of water or other liquid is adequate for proper operation of the invention.

The volume of liquid 38 serves as a means associated with the defined chamber 40 to prevent collapse of the cover portion 16 and the defined chamber 40 after the container 10 is subjected to heat sterilization.

Figure 5:
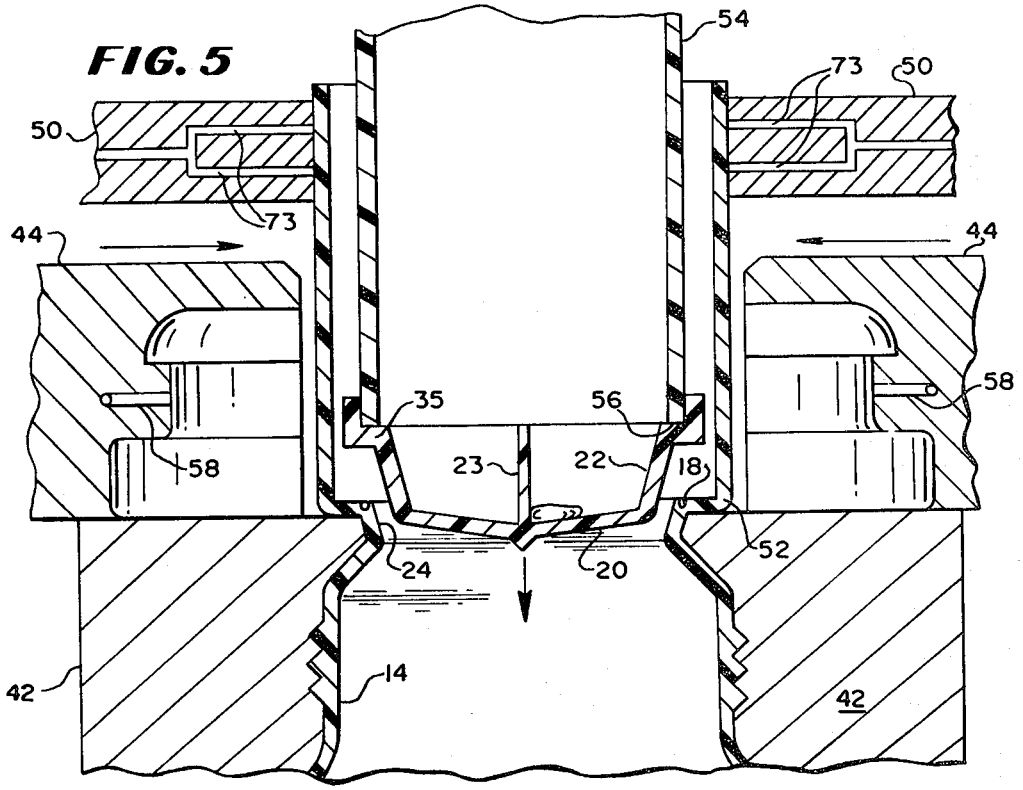
FIG. 5 is a vertical, sectional view of molding apparatus employed for making the container.

Referring now to FIGS. 4 through 6, there is shown the manufacture of the container of the invention, including the intentional addition of liquid 38 in the defined chamber 40.

FIG. 5 depicts molding apparatus and techniques which may be employed to make a container of the type described above. A more detailed description of the molding apparatus and the techniques for molding a one-piece container of the general type shown in the present invention is available in U.S. Pat. No. Re. 27,155. In brief, molding apparatus for the present invention employs a pair of lower mold halves 42 for forming the body portion 12 and neck portion 14 of the container 10 and a pair of relatively movable upper mold halves 44 for forming the cover portion 16 of the container. As seen in FIG. 5, the container of the present invention is formed using the well known technique of blowmolding.

The inner closure 20 is inserted between the mold halves with the specified volume of liquid 38 already inside the inner closure 20. As seen in FIG. 4, a liquid supply tube 46 drops a preferably clean volume of liquid 38 into the pan-shaped inner closure 20 resting on a conveyor surface (not shown). The liquid supply tube 46 may add the volume of liquid 38 in the form of a drop or drops of water or other liquid.

Referring once more to FIG. 5, a molten plastic parison is extruded between the lower and upper mold halves 42, 44, respectively. The upper end of the parison is held open by a pair of vacuum jaws 50 having jaw vacuum ports 73. After the lower mold halves 42 close about the parison, a mandrel (not shown) is inserted into the parison, and injects the contents under pressure thereinto, simultaneously filling the container and expanding the parison to conform to the body and neck mold surfaces of the lower mold halves 42. Simultaneously, an annular ring on the lower end of the mandrel forms the reduced wall thickness portion 18 in the annular shoulder 52 of the container by pressing against the upper surface of the mold halves 42. One technique and a mandrel for forming the reduced wall thickness is described in detail in U.S. Pat. No. 3,597,793. After formation of the container body and neck, the mandrel is withdrawn. A plunger 54 picks up an inner closure 20 with the volume of liquid 38 therein. The inner closure 20 is held on the end 56 of the plunger 54 by an applied vacuum through the plunger 54. It has been found that an applied vacuum of 25 in. Hg works adequately. The applied vacuum does not suck up the volume of liquid 38, probably because the applied vacuum is insufficiently strong to do so. Also, there is no established fluid flow through the plunger 54.

The plunger 54, with the inner closure 20 attached thereto, is inserted between the mold halves 44. The plunger 54 presses the inner closure 20 downwardly, with the side wall 22 in tight contact with the tapered surface 24 of the neck portion 14. In a high speed operation the inner closure 20 would be fed to the plunger 54 by a vibratory feeder or the like. The inside web 23 which extends diametrically across the inner closure is intended to prevent any nesting together of adjacent inner closures, which would interfere with such automatic feeding of the inner closures. Once the inner closure 20 is seated, the vacuum is released. The plunger 54 is then withdrawn.

Next, the upper mold halves 44 are closed inwardly to form the cover portion 16 of the container 10. The upper mold halves 44 are dimensioned to form the outer cover 16 tightly about the rim 35 of the inner closure 20. The upper mold halves 44 include vacuum ports 58, which upon activation draw the parison into close forming contact to the surface of the upper mold halves 44. The formed container 10 is then released from the molds, and the threaded removal ring 26 is subsequently added over the cover 16 and neck 14.

The container contents may be terminally sterilized, i.e., sterilized after the container is formed and filled, sufficiently to destroy microbes or other agents which would otherwise make the contents medically unacceptable. In the preferred embodiment, as an example only, a one liter size container may be heated to 240° F. for a period of about 36 minutes. During this heating step, some of the container contents in the defined volume 21 of the container will be transformed into steam within the body portion 12. However, the seal between the upper, circular rim 35, including the cylindrical wall portion 28 thereof, and the interior surface 34 of the cover portion 16 is good enough to prevent any significant amount of moisture from entering into the defined chamber 40. The seal at the groove 32 may be mechanical or may include a chemical bond formed by the molten plastic upon formation of the cover portion 16 about the inner closure 20. Moisture transmission at the juncture of the rim 35 and the interior surface 34 is further prevented by the seal between the inner closure side wall 22 and the tapered surface 24 of the neck portion 14.

After heat sterilization, the container 10 and the contents are of course quite hot. At this heated temperature, the plastic is somewhat soft and installation of the threaded removal ring 26 is impaired. The removal ring 26 is therefore added only after cooling of the container. Additionally, the container 10 is too hot to be handled by human hands for either installation of the removal ring 26 or for transfer to another work station.

To allow for a faster manufacturing process, the containers are cooled more quickly by spraying them with water 60 from a spray nozzle 62, as seen in FIG. 6. Before employment of the container of the present invention it was found that during the speeded cooling cycle the cover portion 16 often collapsed. Such collapse makes the container 10 commercially unacceptable, makes installation and operation of the removal ring 26 difficult or impossible and furthermore may stress or break the line of weakness 18.

While the exact cause of such collapse is not known, it is believed that the relatively "dry" air trapped in the defined chamber 40 has a lower pressure or PSI value than, for example, the "moist" air in the body portion 12 at a given temperature. Thus, while the body portion 12 remains unharmed, a temperature is reached during the cooling cycle such that the pressure in the defined chamber is low enough, and the plastic is still soft enough, that the cover collapses.

The addition of a volume of liquid 38 in the defined chamber 40 prevents the above-described collapse of the cover portion 14. It is believed, but not known, that the reason for this is that the volume of liquid, which at least partially forms steam within the defined chamber 40, insures a higher PSI value within the chamber 40 at a given temperature, before the plastic cover 16 has set. Although the reason for why the present invention works is not absolutely known, it must be stressed that the present invention does not reside in the identification of the cause of the problem; rather, it is the solution of the problem to which the present invention is directed.

Another embodiment of the invention is illustrated in FIG. 7 wherein there is illustrated a container 10' having a body portion 12', a neck portion 14', a cover portion 16', and a threaded removal ring (not shown), all as in the previous embodiment. Here, the inner closure 64 is not provided with an intentionally added volume of liquid 38. Instead, a vent 66 is disposed between the defined chamber 40' and the defined volume 21'. The vent may be a defined opening in the inner closure 64 which allows for the passage of air, including heated moist air, from the body portion 12 into the defined chamber 40', yet is small enough to prevent any resulting moisture in the defined chamber 40' from dripping back through the vent 66 during opening of the container. FIG. 7 illustrates the container 10' during heat sterilization of the container contents. Moisture in the form of steam passes from the body portion 12' through the vent 66, into the defined chamber 40', thereby providing moist air in the defined chamber for the subsequent cooling cycle.

As explained earlier, it is the solution of the dripping difficulty to which the insert closure 64, in combination with the cover 16, is directed. Thus, it is important that the vent be small enough to trap any moisture which is transferred from the body portion 12' into the defined chamber 40' during heat sterilization. It has been found that a vent opening 66 which is less than about 0.060 in. in diameter and preferably about 0.030 in. in diameter will accomplish this result. A vent opening of such a size not only prevents liquid from dripping out of the chamber, but is also small enough to allow application of the inner closure 64 into the mold halves by use of the vacuum applied through the plunger 54. Apparently, the vent is too small to dislodge the seal between the inner closure 64 and the plunger end 56.

Figure 8:
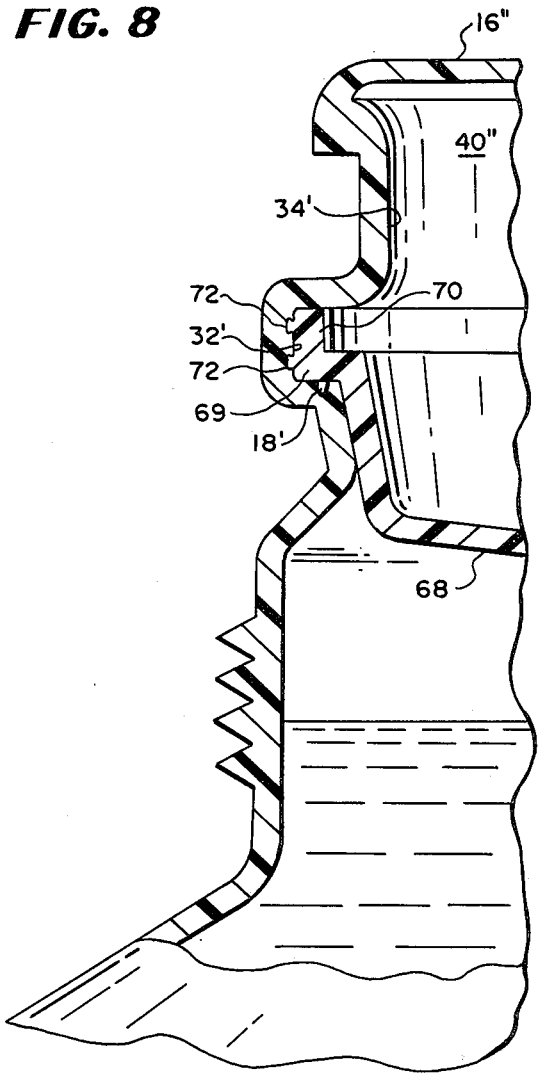
FIG. 8 is a fragmentary, vertical, sectional view of the neck and closure portion of a container embodying the invention, with a modified inner closure having projecting rings.

A modification of the inner closure 20, 64 of either embodiment of the invention discussed above is illustrated in FIG. 8. In FIG. 8 there is shown an inner closure 68 having an upper rim 69 which includes a cylindrical wall portion 70. Projecting rings 72 are disposed around the wall portion 70. It is believed that one or more of the projecting rings 72 is desirable to provide an improved seal between the wall portion 70 and the interior surface 34' of the cover portion 16'' at the groove 32'.

The groove 32' is formed about the wall portion 70, including the projecting rings 72, during the manufacturing process described above, during formation of the cover 16''.

The projecting rings 72 create a torturous pathway which is virtually impossible for the moisture in the defined chamber 40'' to traverse. Thus, especially if the seal between the wall portion 70 and the groove 32' is mechanical, the projecting rings 72 facilitate a moisture barrier seal. This includes preventing any moisture in the defined chamber 40'' from traveling through the seal between the wall portion 70 of the rim 69 and the groove 32', onto the line of weakness 18'.

With the embodiments of the container as described above the contents are isolated below the line of reduced thickness by the inner closure which seals the container neck therebelow. When the contents are needed, a simple turning of the removal ring simultaneously breaks the frangible line to separate the outer closure from the neck and lifts the inner closure out of its nesting engagement with the inner surface of the container neck. When the container 10' employing the vent 66 is used, the vent 66 does not permit any moisture trapped in the chamber 40' from dripping out of the chamber 40' onto the outer surface of the container 10'.

If all the contents are not needed and circumstances permit, the container may be resealed by threading the removal ring onto the neck until the inner closure again seals the neck.

It is believed that the container 10 employing the volume of liquid 38 is somewhat more expensive to manufacture than the container 10' with the vent structure.

Although the present invention has been described in terms of the preferred embodiments, as defined in the appended claims, it is intended to include equivalent structures, some of which may be immediately apparent upon reading this description, and others which may become apparent only after some study.

What is claimed is:

1. In a one-piece, hermetically sealed plastic container having a body portion, a neck portion, a cover portion closing the neck portion and a line of weakness defined between the neck portion and the cover portion to permit separation of said cover portion from said neck portion, the improvement comprising, in combination:

a separately formed inner closure carried by and removable with said cover portion, said inner closure being disposed to seal said neck portion below said line of weakness to prevent the container contents from entering the area of said line of weakness during shipping, storing and handling of the container.

2. A container in accordance with claim 1 wherein said inner closure has a tapered annular side wall for engaging against an annular seat on said neck portion.

3. A container in accordance with claim 2 wherein said annular seat comprises a tapered surface and said tapered annular side wall of said inner closure nestingly seats against the tapered surface of said neck portion.

4. A container in accordance with claim 1 wherein said inner closure further comprises a rim portion engaged by the interior surface of said cover portion.

5. A container in accordance with claim 4 wherein said rim portion is received within a groove in said cover portion.

6. A container in accordance with claim 5 wherein said rim portion comprises a cylindrical wall portion captured between radially extending portions of said cover portion.

7. A container in accordance with claim 1 wherein said neck portion is threaded, and further comprising a removal ring threadedly received on said neck portion and operable upon rotation to exert an axial force on said cover portion to break said line of weakness for removal of said cover portion and said inner closure.

8. A container in accordance with claim 7 wherein said cover portion has an annular indented channel on the exterior surface and said removal ring has a plurality of inwardly directed fingers adapted to snap into said groove when said removal ring is threaded onto the container neck portion, and to engage against the surface of said groove to exert an axial force on said cover portion when said removal ring is rotated in the opposite direction.

9. A container in accordance with claim 7 wherein said removal ring and said cover portion have interengaging surfaces to force said inner closure into sealing contact with said container neck upon reattachment of said removal ring and cover portion to said container.

10. A container in accordance with claim 2 wherein said inner closure includes a diametrical web spanning said tapered side wall.

11. In a container comprising a body portion, a threaded neck portion and a cover portion closing said neck portion, all of one-piece plastic construction, a frangible line of weakness defined between said neck portion and said cover portion, and a removal ring threadedly received on said neck portion and operable upon rotation to exert an axial force against said cover member to fracture said line of weakness for removal of said cover portion, the improvement comprising, in combination:

a separately formed inner closure carried by and removable with said cover portion and having an annular tapered side wall portion;

said neck portion defining an annular tapered seat below said line of weakness and engaging against said tapered side wall portion of said inner closure to prevent the contents of the container from entering the area of said line of weakness during shipping, storing or handling.

12. A container in accordance with claim 11 wherein said inner closure further comprises an annular rim received within a groove defined by the wall of said cover portion.

13. A container in accordance with claim 10 wherein said line of weakness comprises a line of reduced wall thickness in a radially extending shoulder in said container.

14. A container in accordance with claim 1 wherein said inner closure is made of a material different from that of the container neck portion.

15. A container in accordance with claim 1 wherein said inner closure is made of the same material as said container.

16. A hermetically sealed, heat-sterilizable plastic container comprising:

(a) a body portion;

(b) a neck portion extending from said body portion, said body and neck portions defining a volume;

(c) a cover portion closing the neck portion;

(d) a line of weakness defined between said neck portion and said cover portion to permit separation of said cover portion from said neck portion;

(e) an inner closure carried by said cover portion and disposed to liquid-seal said neck portion from said line of weakness;

(f) a chamber defined by said cover portion and said inner closure; and (g) means associated with said defined chamber to prevent collapse of said cover portion after said container is subjected to heat-sterilization.

17. The container as in claim 16, wherein said inner closure is removable with said cover portion.

18. The container as in claim 16, wherein said means comprises a vent between said defined chamber and said defined volume, said vent including an opening in said closure small enough to prevent liquid in said chamber from dripping out of said opening, and further wherein said defined volume contains a liquid.

19. The container as in claim 18, wherein said vent has a diameter not greater than about 0.060 in.

20. The container as in claim 18, wherein said vent has a diameter not greater than about 0.030 in.

21. The container as in claim 18, wherein said inner closure includes a rim portion engaged against, and carried by, the interior surface of said cover portion, said rim portion comprising a wall portion having at least one projecting ring extending therearound, such that the interior surface of said cover portion conforms to said rim portion, including said projecting ring.

22. The container as in claim 16, wherein said defined chamber is closed and said means comprises liquid in said chamber.

23. The container as in claim 22, wherein said inner closure includes a rim portion engaged against, and carried by, the interior surface of said cover portion, said rim portion comprising a wall portion having at least one projecting ring extending therearound, such that the interior surface of said cover portion conforms to said rim portion, including said projecting ring.

24. The container as in claim 16, wherein said inner closure further comprises an annular sidewall and a bottom wall depending from said annular sidewall, said bottom wall having a sloping outer surface terminating in a tip, said tip having a steeper slope than said outer surface, said outer surface and said tip preventing liquid in said defined volume from adhering to said bottom wall.

25. A hermetically sealed, heat-sterilizable container comprising:

(a) a body portion;

(b) a neck portion extending from said body portion, said body and neck portion defining a volume containing a liquid;

(c) a cover portion closing the neck portion;

(d) a line of reduced wall thickness between said neck portion and said cover portion to permit separation of said cover portion from said neck portion;

(e) an inner closure including a radially extending rim portion engaged against, and carried by, the interior surface of said cover portion, said inner closure further including a tapered annular sidewall for engaging an annular seat on said neck portion;

(f) a chamber defined by said cover portion and said inner closure; and (g) a vent between said defined chamber and said defined volume, said vent including an opening in said inner closure small enough to prevent any liquid transferred to said chamber from dripping out of said opening.

26. The container as in claim 25, wherein said inner closure is removable with said cover portion.

27. The container as in claim 25, wherein said rim portion comprises a cylindrical wall portion having at least one projecting ring extending around said wall portion, such that the interior surface of said cover portion conforms to said rim portion, including said projecting ring.

28. The container as in claim 25, wherein said inner closure further comprises a bottom wall depending from said annular sidewall, said bottom wall having a sloping outer surface terminating in a tip, said tip having a steeper slope than said outer surface, said outer surface and said tip preventing liquid in said defined volume from adhering to said bottom wall.

29. A hermetically sealed, heat-sterilizable container comprising:

(a) a body portion;

(b) a neck portion extending from said body portion, said body and neck portion defining a volume;

(c) a cover portion closing the neck portion;

(d) a line of reduced wall thickness between said neck portion and said cover portion to permit separation of said cover portion from said neck portion;

(e) an inner closure including a radially extending rim portion engaged against, and carried by, the interior surface of said cover portion, said inner closure further including a tapered annular sidewall for engaging an annular seat on said neck portion;

(f) a closed chamber defined by said cover portion and said inner closure; and (g) liquid in said closed chamber.

30. The container as in claim 29, wherein said rim portion comprises a cylindrical wall portion having at least one projecting ring extending around said wall portion, such that the interior surface of said cover portion conforms to said rim portion, including said projecting ring.

31. The container as in claim 29, wherein said inner closure further comprises a bottom wall depending from said annular sidewall, said bottom wall having a sloping outer surface terminating in a tip, said tip having a steeper slope than said outer surface, said outer surface and said tip preventing liquid in said defined volume from adhering to said bottom wall.

32. A method for sterilizing a plastic container which includes body and neck portions defining a volume, a cover portion closing the neck portion and a closure engaging the neck portion, carried by the cover portion and disposed to segregate the container contents from a line of weakness defined between the neck and cover portions, the steps comprising:

(a) providing moisture in the chamber defined by the closure and the cover portion;

(b) heating the container at a temperature and for a time period sufficient to sterilize the container contents;

(c) wherein said step of providing moisture to the defined chamber assures that liquid will not drip out of the defined chamber upon subsequent opening of the container at the line of weakness.

* * * * *